US011118733B2

(12) United States Patent
Ye et al.

(10) Patent No.: US 11,118,733 B2
(45) Date of Patent: Sep. 14, 2021

(54) THREE-DIMENSIONAL LAYOUTLAYOUT METHOD FOR SPLICING VAULT PLATES OF LARGE LNG STORAGE TANK

(71) Applicants: CHINA NATIONAL OFFSHORE OIL CORP., Beijing (CN); OFFSHORE OIL ENGINEERING CO., LTD., Tianjin (CN); Tianjin University, Tianjin (CN)

(72) Inventors: Zhongzhi Ye, Tianjin (CN); Jing Lu, Tianjin (CN); Xiqiang Zhang, Tianjin (CN); Juan Su, Tianjin (CN); Jian Su, Tianjin (CN); Qing Zhang, Tianjin (CN); Yu Sun, Tianjin (CN); Fudan Zhou, Tianjin (CN); Yu Wang, Tianjin (CN); Wenduo He, Tianjin (CN)

(73) Assignees: CHINA NATIONAL OFFSHORE OIL CORP., Beijing (CN); OFFSHORE OIL ENGINEERING CO., LTD., Tianjin (CN); TIANJIN UNIVERSITY, Tianjin (CN)

( * ) Notice: Subject to any disclaimer, the term of this patent is extended or adjusted under 35 U.S.C. 154(b) by 0 days.

(21) Appl. No.: 15/839,858

(22) Filed: Dec. 13, 2017

(65) Prior Publication Data

US 2019/0178443 A1 Jun. 13, 2019

(51) Int. Cl.
*F17C 3/02* (2006.01)
*F17C 3/00* (2006.01)

(52) U.S. Cl.
CPC ..... *F17C 3/02* (2013.01); *F17C 3/00* (2013.01); *F17C 2201/0109* (2013.01);
(Continued)

(58) Field of Classification Search
CPC ..... F17C 3/00; F17C 3/02; F17C 2201/0109; F17C 2201/0119; F17C 2201/0157;
(Continued)

(56) References Cited

U.S. PATENT DOCUMENTS 3,462,521 A * 8/1969 Dante ..... E04B 1/169 264/32
5,408,793 A * 4/1995 Dykmans ..... B65D 88/34 52/81.6

(Continued)

FOREIGN PATENT DOCUMENTS

CN 1644826 A * 7/2005
CN 104036544 A * 9/2014

(Continued)

*Primary Examiner* — Jacob J Cigna
(74) *Attorney, Agent, or Firm* — George G. Wang; Bei & Ocean

(57) ABSTRACT

Method of constructing a vault of a large storage tank for liquefied natural gas by first modeling the vault with a 3-D modeling software application, then partially building the vault with a framework and a first set of covering panels fixed on the framework where the panels do not touch each other, but leave a number of gaps between them, measuring the dimensions of the actual gaps between the panels using a 3-D scanner, producing a second set of panels according to the scanned dimensional data, and finally filled the gaps between the first set of panels with the second set of panels, which are much smaller than the first set of panels, making the building process earlier and more accurate, which are difficult issues in building large tanks for liquefied natural gas.

5 Claims, 9 Drawing Sheets

(52) U.S. Cl.
CPC ..... *F17C 2201/0119* (2013.01); *F17C 2201/0157* (2013.01); *F17C 2201/052* (2013.01); *F17C 2203/012* (2013.01); *F17C 2209/22* (2013.01); *F17C 2209/221* (2013.01); *F17C 2209/234* (2013.01); *F17C 2221/033* (2013.01); *F17C 2223/0161* (2013.01); *F17C 2223/033* (2013.01); *F17C 2260/013* (2013.01); *F17C 2260/017* (2013.01); *F17C 2270/01* (2013.01); *F17C 2270/0134* (2013.01)

(58) Field of Classification Search
CPC ..... F17C 2201/052; F17C 2203/012; F17C 2209/22; F17C 2209/221; F17C 2209/234; F17C 2221/033; F17C 2223/0161; F17C 2223/033; F17C 2260/013; F17C 2260/017; F17C 2270/01; F17C 2270/0134
See application file for complete search history.

(56) References Cited

U.S. PATENT DOCUMENTS 5,724,775 A * 3/1998 Zobel, Jr. ..... E04B 1/3211 359/443
7,591,108 B2 * 9/2009 Tuczek ..... E04B 7/102 52/80.1
9,783,983 B1 * 10/2017 Fairbanks ..... E04B 7/102
10,077,572 B1 * 9/2018 Bowen ..... E04H 7/00
2001/0040160 A1 * 11/2001 Gulati ..... B21D 47/00 220/4.12
2004/0188446 A1 * 9/2004 Gulati ..... F17C 3/00 220/651
2007/0251161 A1 * 11/2007 Tuczek ..... E04B 7/102 52/80.1
2010/0154318 A1 * 6/2010 Shockley ..... E04B 5/43 52/82
2010/0154319 A1 * 6/2010 Shockley ..... E04H 7/18 52/82
2010/0154320 A1 * 6/2010 Shockley ..... E04H 7/18 52/82
2010/0154332 A1 * 6/2010 Shockley ..... E04C 3/22 52/223.3
2011/0283638 A1 * 11/2011 Shockley ..... E04B 5/43 52/231
2012/0023845 A1 * 2/2012 Shockley ..... E04C 3/22 52/223.7
2014/0360891 A1 * 12/2014 Kline ..... F17C 11/005 206/0.7
2015/0121772 A1 * 5/2015 Berken ..... E04B 1/34331 52/28
2016/0024780 A1 * 1/2016 Sevtsuk ..... E04B 1/32 52/474
2016/0078681 A1 * 3/2016 Shikoda ..... G06T 19/006 345/633
2018/0071949 A1 * 3/2018 Giles ..... B33Y 10/00

FOREIGN PATENT DOCUMENTS

CN 104166760 A * 11/2014
CN 104180771 A * 12/2014
CN 107036544 A * 8/2017
ES 2643756 A1 * 11/2017
WO WO-2015130242 A2 * 9/2015 ..... E04B 1/32

* cited by examiner

THREE-DIMENSIONAL LAYOUTLAYOUT METHOD FOR SPLICING VAULT PLATES OF LARGE LNG STORAGE TANK

TECHNICAL FIELD

The present invention relates to a method of building the top vault of large storage tanks for storage and transportation liquefied natural gas (hereinafter referred to as LNG).

BACKGROUND OF THE PRESENT INVENTION

During the storage and transportation of the LNG, LNG storage tanks play a very important role. FIG. 1 is a schematic diagram of the vault plates before hoisting, welding and air lifting.

A vault for an LNG storage tank consists of an arc beam and vault plates. Normally, there are a central vault plate and dozens of large and small vault plates at a construction site, which are dozens of tons in weight and dozens of meters in length. As shown in FIG. 2, a vault of a 160,000-square LNG storage tank comprises a central vault plate (25), twelve large vault plates (1, 3, 5, 7, 9, 11, 13, 15, 17, 19, 21 and 23) and twelve small vault plates (2, 4, 6, 8, 10, 12, 14, 16, 18, 20, 22 and 24), wherein the large vault plates are weighed 18 tons and the small vault plates are weighed 9 tons.

The vault plates are mounted by the following steps: mounting the central circular vault plate (25) and four large vault plates (1, 7, 13 and 19) in a symmetric cross shape first, and then hoisting other large vault plates (3, 5, 9, 11, 15, 17, 21 and 23) successively, and hoisting the small vault plates (2, 4, 6, 8, 10, 12, 14, 16, 18, 20, 22 and 24) in place successively; assembling and welding the vault plates and the arc beam; measuring the gaps between the large and small vault plates, and finally performing the construction layout according to the measurement results.

The conventional mounting has the following problems:

1. High risk: during manual measuring at a high altitude in site, construction personnel require walking on a steel skeleton for measuring, resulting in high operation risk;
2. Low construction efficiency: since there are numerous vault plates to be measured successively by the construction personnel before mounting, the construction efficiency is low;
3. Low measurement accuracy: since it is difficult to control the size of arc surface of the vault plates, the accuracy of the butt joints between the vault plates is low;
4. Difficulty in analysis: a layout graph is obtained by a series of complicated calculations according to the measured data of the vault plates, so it is very difficult for analysis.

SUMMARY OF THE PRESENT INVENTION

An object of the present invention is to overcome the defects in the prior art and the object is achieved by a building method based on the steps: (1) 3-D modeling of the vault to be built, (2) partially building the vault on the top of the tank with a first set of panels made according to the modeling data, where in the partial construct the panels do not touch each other but leave a gap therebetween, (3) measuring the dimension of the actual gap on the partial construct using a 3-D scanner, (4) preparing a second set of the panels corresponding to the gaps on the partial construct based on the scanned dimensional data, (5) filling the gaps on the partial construct with the second set of the panels and fixing them thereon. The second set of the panels is significantly smaller than the first set so that it is easier to make them fit the corresponding gaps accurately. Therefore, the present invention provides a three-dimensional layout method for splicing vault plates of a large LNG storage tank, which can realize a high-efficiency and high-accuracy splicing during the construction of a vault of a large LNG storage tank.

The three-dimensional layout method for splicing vault plates of a large LNG storage tank is provided, including the following steps:

(1) Establishing a three-dimensional model of an ideal vault in an ideal coordinate system O-XYZ by using CAD software, and extracting contour lines of small and large vault plates as contour feature lines of the three-dimensional model of the ideal vault, which assist curve fitting of point cloud data;

(2) Scanning vault plates, the detailed steps include:

Hoisting the central circular vault plate, large vault plates and small vault plates, arranging four measuring points on a cylindrical roof at an interval of 90 degrees, and arranging a three-dimensional laser scanner at each measuring point for scanning the vault;

(3) Transforming the coordinate of the point cloud data of the vault plates, scanned by each scanner within the range of a quarter of vault from a point could coordinate system, to the ideal coordinate system obtained in the step (1);

(4) Generating a cylinder by using a contour feature line of the ideal three-dimensional model as an axis, selecting point cloud data inside the cylinder, searching neighborhood point cloud data around each of the contour feature lines and removing redundant "noise point cloud" (that is the noise point exists in the point cloud) to obtain valid point cloud data;

(5) Performing curve fitting respectively on the searched valid point cloud data in the ideal coordinate system to obtain dimension data required for fitting the vault, the dimension data comprising dimension data of a vault splice plate to be mounted at gaps among each small vault plate and two adjacent large vault plates and dimension data of a vault splice plate to be mounted at a gap between each small vault plate and the central circular vault plate; the dimension data of each vault splice plate to be mounted specifically comprising the radius $r_{AB}$ and arc length $C_1$ of a left side arc AB of each vault splice plate in a radial direction of the vault, the radius $r_{CD}$ and arc length $C_2$ of a right side arc CD of each vault splice plate in the radial direction of the vault, an included angle a between two projection straight lines $l_1$ and $l_2$ of the left side arc AB and the right side arc CD of each vault splice plate in an OXY plane of the ideal coordinate system, the radius $r_1$ of a projection arc A'D' of an inside arc AD of each vault splice plate arranged in a circumferential direction of the vault in the OXY plane of the ideal coordinate system and the radius $r_2$ of a projection arc B'C' of an outside arc BC of each vault splice plate arranged in the circumferential direction of the vault in the OXY plane of the ideal coordinate system;

(6) Performing construction layout of the vault splice plates, the detailed steps includes:

Step A: obtaining the radius $R_1$ of an inside arc MN and radius $R_2$ of an outside arc PQ of a construction layout plate of the vault splice plates arranged in the circumferential direction of the vault by the following formulae, respectively:

$$R_1 = \frac{r_{AB} + r_{CD}}{2} * \tan\left(\arcsin\frac{2r_1}{r_{AB} + r_{CD}}\right)$$

-continued $$R_2 = \frac{r_{AB} + r_{CD}}{2} * \tan\left(\arcsin\frac{2r_2}{r_{AB} + r_{CD}}\right)$$

Wherein, $r_1$ is the radius of the projection arc A'D' of the inside arc AD of each vault splice plate arranged in the circumferential direction of the vault in the OXY plane of the ideal coordinate system, and $r_2$ is the radius of the projection arc B'C' of the outside arc BC of each vault splice plate arranged in the circumferential direction of the vault in the OXY plane of the ideal coordinate system;

Step B: constructing a line segment EF, wherein the length of the EF is an average value of the arc length $C_1$ of the left side arc AB and the arc length $C_2$ of the right side arc CD of each vault splice plate in the radial direction of the vault:

$$EF=(C_1+C_2)/2$$

Step C: constructing arcs MN and PQ by using the radius $R_1$ of the inside arc and the radius $R_2$ of the outside arc of the construction layout plate of the vault splice plates arranged in the circumferential direction of the vault as radius and using point E and point F as points on the arcs, wherein the centers of the arcs MN and PQ are $O_1$ and $O_2$ respectively and located on an extended line of the line segment EF; taking a as the central angle of each of the arcs MN and PQ, connecting the MQ and NP, and obtaining MNPQ as the layout dimension data of the steel plate to be calculated;

(7) Shifting four sides of the MNPQ outwardly, connecting clearances, formed at four corners after shifting, by straight lines to obtain a layout graph for the vault splice plates, and prefabricating and constructing the vault splice plates to be mounted according to the layout graph for the vault splice plates.

In summary, the present invention provides a method of constructing a vault of a large storage tank for liquefied natural gas, comprising the steps of (a) modeling the vault of the large storage tank using a 3-D CAD application to generate a set of model data that display the vault as an umbrella type dome, formed from a plurality of panels fixed on a framework of parallels and meridians;

(b) producing a first set of panels having shapes and dimensions predetermined according to the modeling data generated in step (a) and producing a plurality of framework members according to the modeling data generated in step (a);

(c) on the top of a storage tank's main body, constructing a vault framework based on the model data generated in step (a) by connecting and fixing framework members to form the parallels and meridians of the framework;

(d) partially covering the framework built in step (c) by fixing the first set of panels according to the vault model of step (a), wherein the panels do not touch each other but leave a plurality of uncovered spaces between the panels;

(e) obtaining dimensional data of the uncovered spaces by using a 3-D scanner and producing a second set of panels according to the scanned dimensional data, each of which panels perfectly fits in one of the uncovered spaces; and (f) placing and fixing the second set of panels into the uncovered spaces between the first set of panels that are already fixed on the framework to result in fully covered vault as the top of the storage tank.

Preferably, the size of the second panels is smaller than the size of the first set of panels because it is would be easier to make smaller panels more dimensionally accurate and the requirement for accuracy more stringent for the second set of panels than the first set of panels. The first set of panels can be made with less dimensional accuracy as the any inaccuracies are accounted for in the subsequent 3-D scanning measurement. It can appreciated that the actual scanned dimensional data for each second set of panels, while fall within a certain range, may be varied from each other, depending on the actual dimensions of the gaps.

Further preferably, the second set of panels can be made of different sizes and shapes as a way to make the installation of the panels easier, more accurate and more convenient. In additionally, the first set of panels may also be made of different sizes and shapes to suit for particular building situations.

The "parallels" and "meridians" are terms borrowed from the global map. Here in the present invention, "meridians" are framework members that run from the base rim and converge at the top point the vault/dome construct while "parallels" are framework members that run parallel to each other and do not converge. The meridians run across the parallels and they collectively form a dome shaped framework to support panels.

In the present invention, the three-dimensional modeling of the vault can be made using any 3-D CAD application, which is commercially available, such as AutoCAD. The 3-D scanning can be conducted using any suitable 3-D scanner, which is commercially available, such as LEICA HDS7000 3-D laser scanner.

The present invention has the following beneficial effects: the construction risk caused by the manual measurement is reduced, the measurement accuracy is significantly improved in comparison to the manual measurement, and the layout dimension of the vault splice plates can be obtained directly which greatly reduces the labor cost and improves the installation efficiency of the vault of the storage tank.

DETAILED DESCRIPTION OF THE PRESENT INVENTION

The detailed embodiments of the present invention will be described below with reference to the accompanying drawings.

As shown in the figures, the three-dimensional layout method for splicing vault plates of a large LNG storage tank of the present invention includes the following steps.

Figure 1:
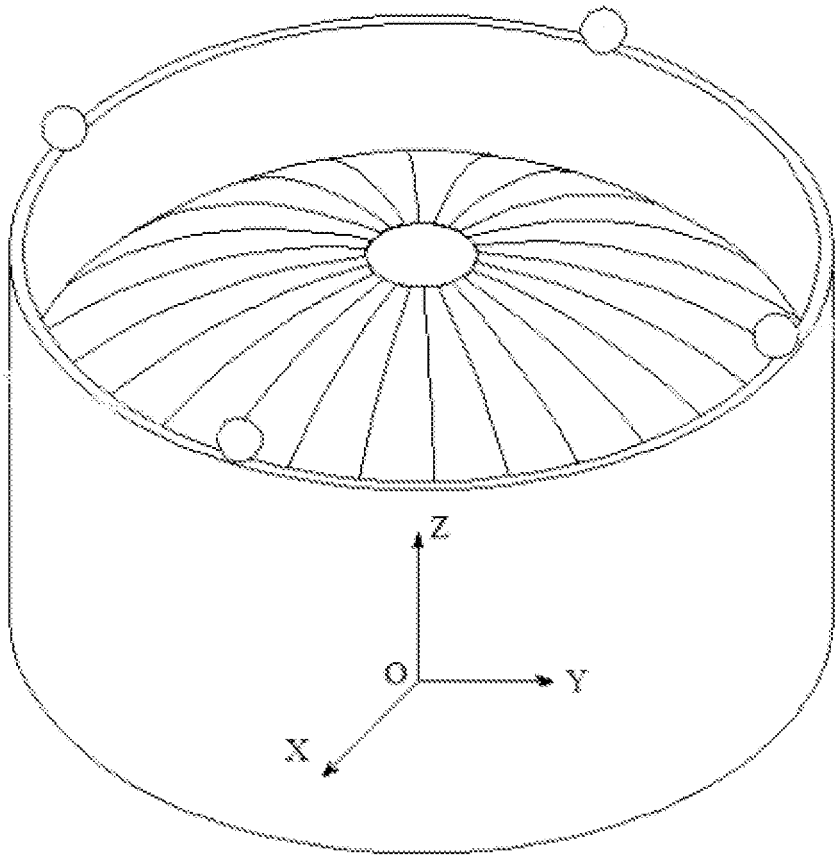
FIG. 1 (Prior Art)
FIG. 1 is a schematic diagram of the vault plates before hoisting and welding and air lifting.
Figure 2:
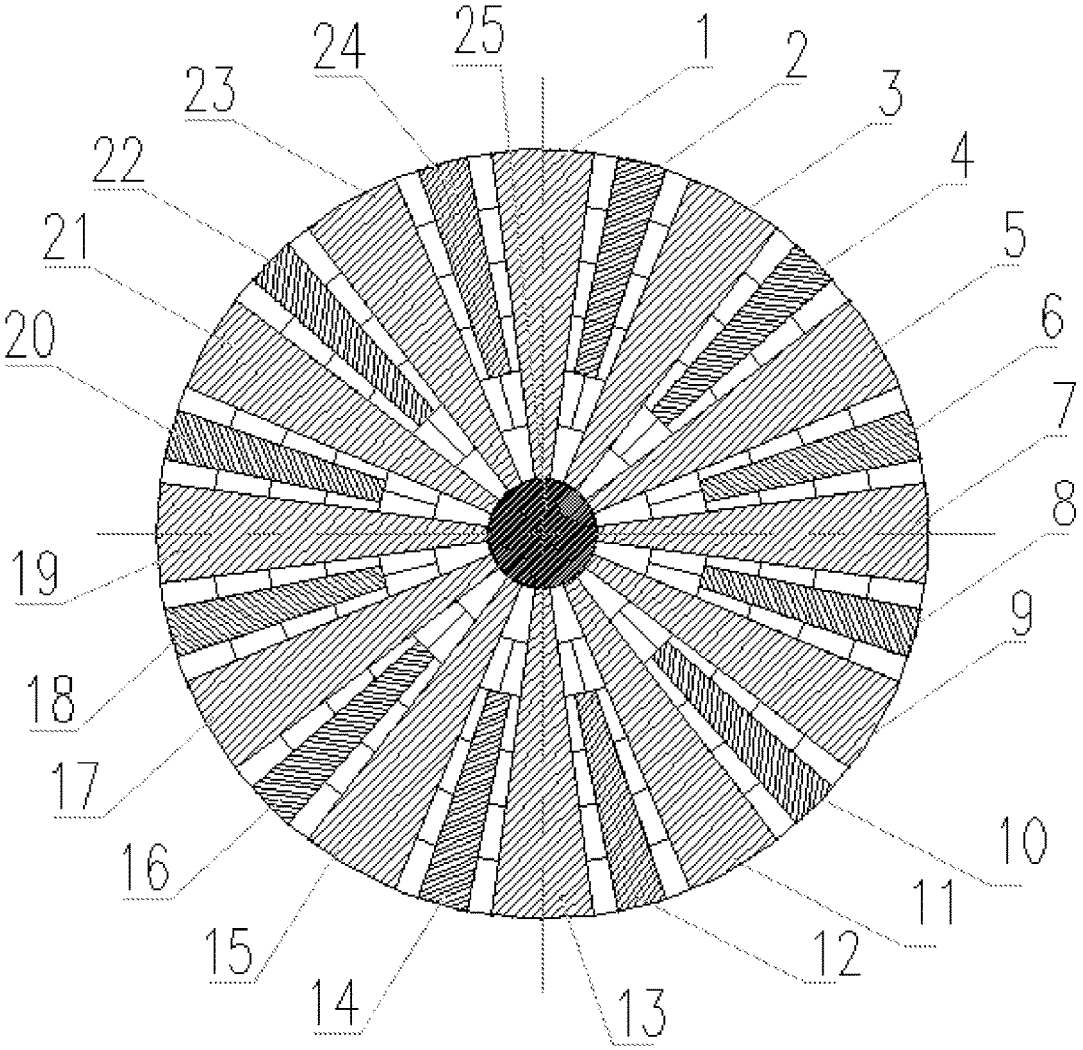
FIG. 2 (Prior Art)
FIG. 2 is a structural diagram of a vault of a 160,000-square LNG storage tank, where the first set of panels are shown as 1-24 of two types (with different size and shape) labeled by odd numbers and even numbers, respectively.
Figure 3:
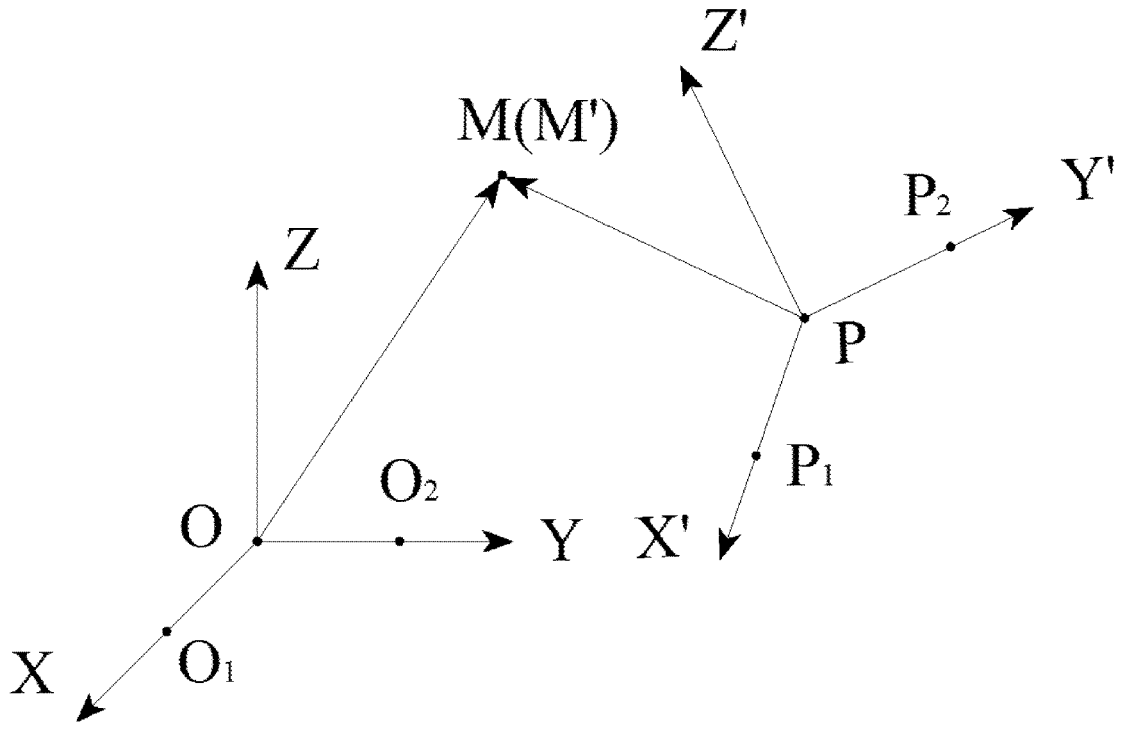
FIG. 3 is a schematic diagram of the coordination transformation between an ideal coordinate system and a point cloud coordinate system.

(1) Establishing a three-dimensional model of an ideal vault in an ideal coordinate system O-XYZ by using CAD software, and extracting contour lines of small and large vault plates as contour feature lines of the three-dimensional model of the ideal vault, which assist curve fitting of point cloud data;

(2) Scanning vault plates, the detailed steps include:

Hoisting a central circular vault plate, large vault plates and small vault plates, arranging four measuring points on a cylindrical roof at an interval of 90 degrees, and arranging a three-dimensional laser scanner at each measuring point for scanning the vault;

(3) Transforming the coordinate of the point cloud data of the vault plates, scanned by each scanner within the range of a quarter of vault from a point could coordinate system, to the ideal coordinate system obtained in the step (1), the detailed method is as follows:

As shown in FIG. 3, the origin of the point cloud coordinate system is P, and points $P_1$ and $P_2$ are taken from the X'-axis and Y'-axis, respectively; and, the origin of the ideal coordinate system is 0, and points $O_1$ and $O_2$ are taken from the X-axis and Y-axis of the coordinate system, respectively.

The unit vectors of each coordinate axis in the point cloud coordinate system deduced by using the above points are:

$$e_1' = \frac{P_1 - P}{|P_1 - P|},\ e_2' = \frac{P_2 - P}{|P_2 - P|},\ e_3' = e_1' \times e_2' \tag{1}$$

Wherein, $e_1'$, $e_2'$ and $e_3'$ are unit vectors of the X'-axis, Y'-axis and 2-axis in the point cloud coordinate system, respectively.

Similarly, unit vectors $e_1$, $e_2$ and $e_3$ of the X-axis, Y-axis and Z-axis in the ideal coordinate systems can be obtained as follows:

$$e_1 = \frac{O_1 - O}{|O_1 - O|},\ e_2 = \frac{O_2 - O}{|O_2 - O|},\ e_3 = e_1 \times e_2 \tag{2}$$

M and M' are coordinates of a same feature point in the ideal model and the point cloud model, respectively, so there's the following equation:

$$[e_1,e_2,e_3]^T M=[e_1',e_2',e_3']^T M' \tag{3}$$

$$M=([e_1,e_2,e_3]^T)^{-1}[e_1',e_2',e_3']^T M' \tag{4}$$

Therefore, the rotation R of a transformation matrix can be expressed as:

$$R=([e_1,e_2,e_3]^T)^{-1}[e_1',e_2',e_3']^T \tag{5}$$

The translation T can be expressed as:

$$T=O-P \tag{6}$$

Therefore, the complete transformation matrix transformed from the point cloud coordinate system to the ideal coordinate system is:

$$C = \begin{bmatrix} R & T \\ 0 & 1 \end{bmatrix} \tag{7}$$

Figure 4:
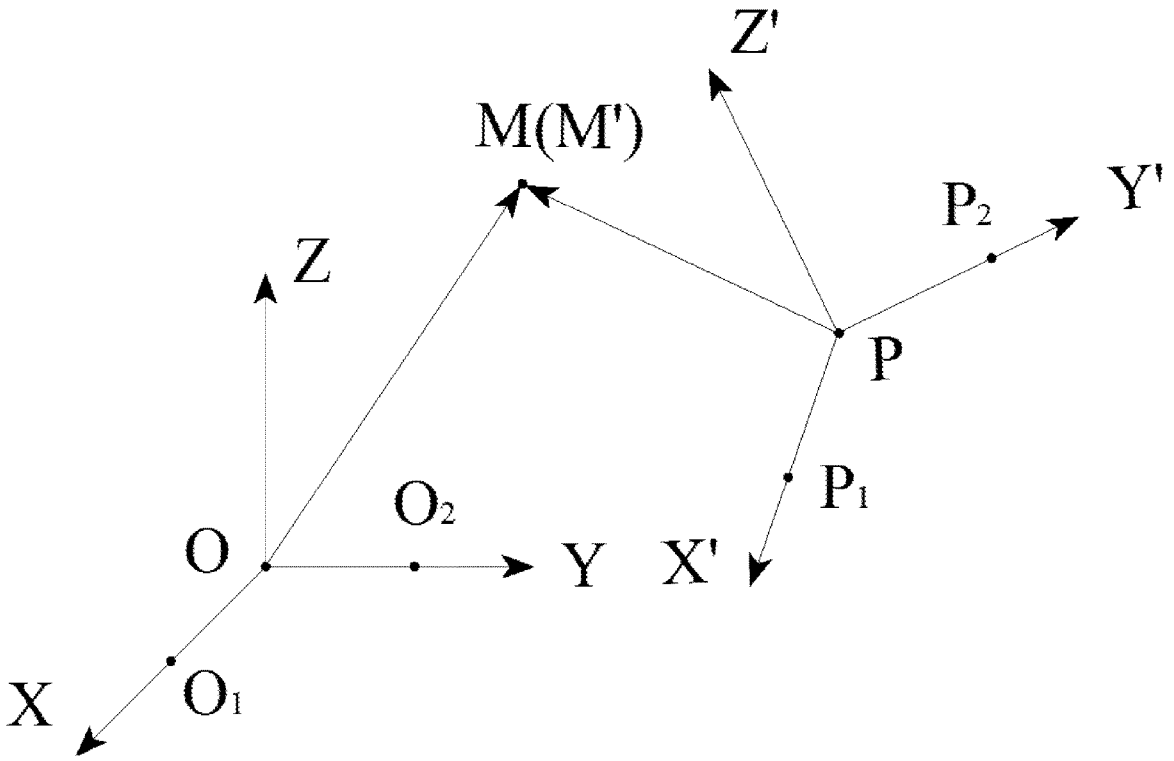
FIG. 4 is a schematic diagram of point cloud de-noising based on counter lines of an ideal model.
Figure 5:
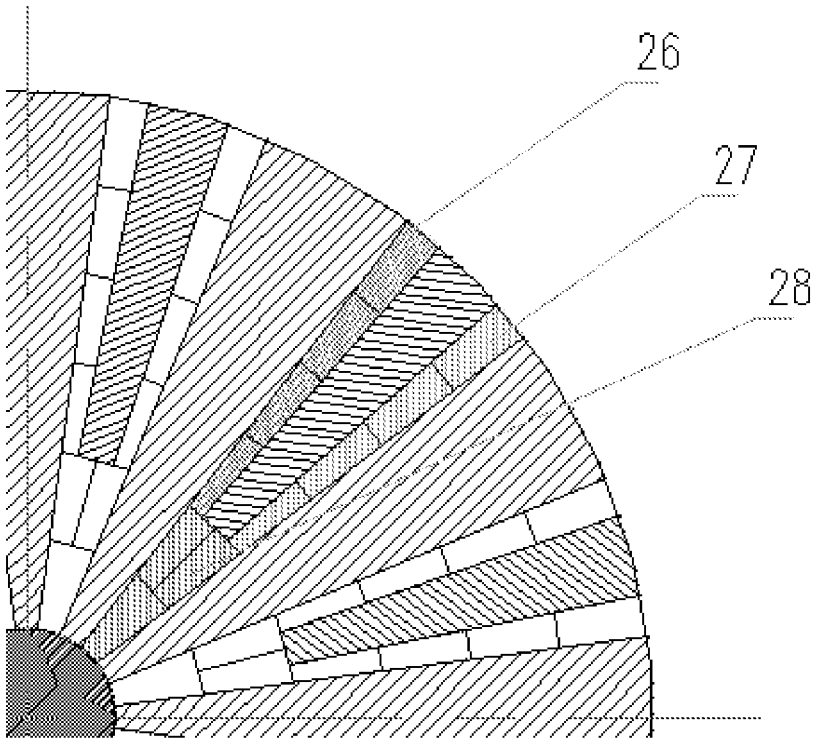
FIG. 5 is a schematic diagram of a gap to be fitted in a quarter of the vault.
Figure 6:
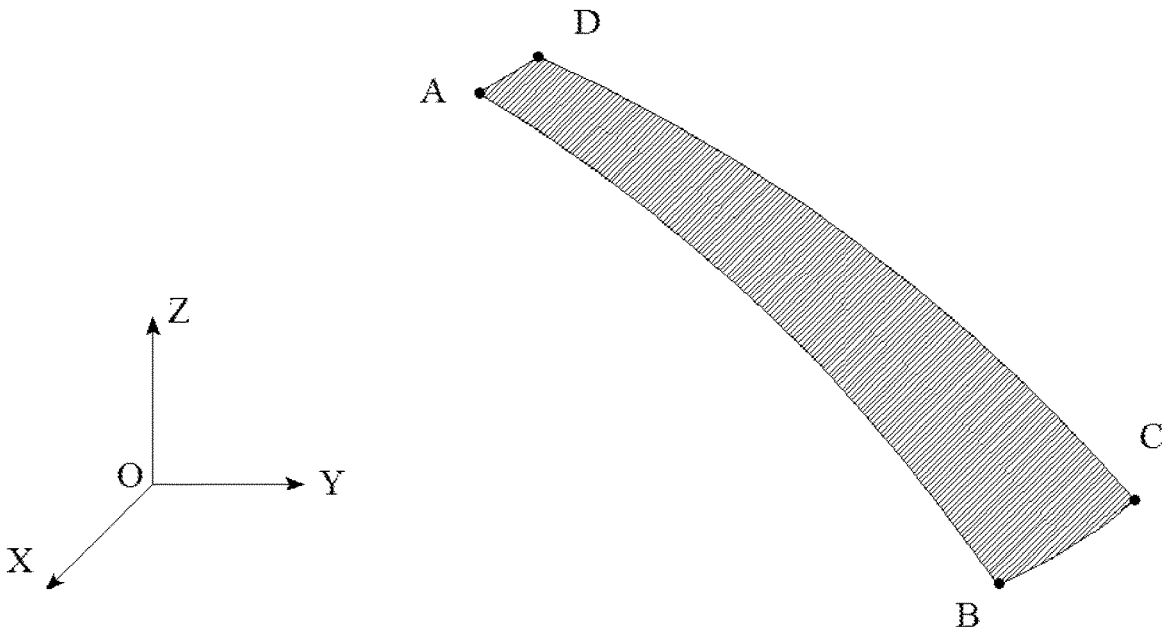
FIG. 6 is a 3-D schematic diagram of vault splice plates to be fitted.

(4) As shown in FIG. 4, generating a cylinder by using a contour feature line of the ideal three-dimensional model as an axis, selecting point cloud data inside the cylinder, searching neighborhood point cloud data around each of the contour feature lines and removing redundant "noise point cloud" to obtain valid point cloud data;

(5) Performing curve fitting respectively on the searched valid point cloud data in the ideal coordinate system to obtain dimension data required for fitting the vault, the dimension data comprising dimension data of a vault splice plate to be mounted at gaps among each small vault plate and two adjacent large vault plates and dimension data of a vault splice plate to be mounted at a gap between each small vault plate and the central circular vault plate; the dimension data of each vault splice plate to be mounted specifically comprising the radius $r_{AB}$ and arc length $C_1$ of a left side arc AB of each vault splice plate in a radial direction of the vault, the radius $r_{CD}$ and arc length $C_2$ of a right side arc CD of each vault splice plate in the radial direction of the vault, an included angle a between two projection straight lines $l_1$ and $l_2$ of the left side arc AB and the right side arc CD of each vault splice plate in an OXY plane of the ideal coordinate system, the radius $r_1$ of a projection arc A'D' of an inside arc AD of each vault splice plate arranged in a circumferential direction of the vault in the OXY plane of the ideal coordinate system and the radius $r_2$ of a projection arc B'C' of an outside arc BC of each vault splice plate arranged in the circumferential direction of the vault in the OXY plane of the ideal coordinate system. The detailed steps are as follows:

As shown in FIG. 5, the gaps 26,27 among each small vault plate and two neighboring large vault plates and the gap 28 between each small vault plate and the central circular vault plate successively perform curve fitting and layout;

Step A: Calculating the radius $r_{AB}$ of the left side arc AB and radius $r_{CD}$ of the right side arc CD of each vault splice plate in the radial direction of the vault;

FIG. 6 is a 3-D schematic diagram of vault splice plates to be fitted. The arc AB and arc CD in FIG. 6 are fitted by the least square method based on radius constraint.

The equation of a circle may be expressed as:

$$(x-x_0)^2+(y-y_0)^2+(z-z_0)^2=r^2 \tag{8}$$

Wherein, $(x_0, y_0, z_0)$ is the center coordinates of the circle in which the arc is to be fitted, and r is the actual radius of the arc to be fitted.

For the circle fitting based on a nonlinear least square method, an optimized target function is:

$$\min C = \sum_{i=1}^{N} \left( \sqrt{(x_i - x_0)^2 + (y - y_0)^2 + (z_i - z_0)^2} - r \right)^2 \tag{9}$$

Wherein, $(x_i, y_i, z_i)$ is coordinates of a feature point on the arc to be fitted, $(x_0, y_0, z_0)$ is the center coordinate of the circle in which the arc is to be fitted, r is the actual radius of each vault splice plate to be fitted, and N is the number of feature points participating in the fitting calculation.

When the radius of circle is used as a constraint participating in the fitting, according to the Lagrange multiplier method, the optimized target function of the least square method may be expressed as:

$$\min C = \sum_{i=1}^{N}\left(\sqrt{(x_i - x_0)^2 + (y - y_0)^2 + (z_i - z_0)^2} - r\right)^2 + \lambda(r - r_k) \tag{10}$$

Wherein, $(x_i, y_i, z_i)$ is coordinates of a feature point on the arc AB and arc CD; $(x_0, y_0, z_0)$ is center coordinates of the circle of the arc AB and the arc CD; $\lambda$ is the Lagrange constant; r is the actual radius of the vault splice plate to be fitted; $r_k$ is the design radius of the arc AB and the arc CD; and, N is the number of feature points participating in the fitting calculation.

Step B: Calculating the arc lengths $C_1$ of the left side arc AB and $C_2$ of the right side arc CD of each vault splice plate in the radial direction of the vault;

Assuming the coordinates of points A and B as $(x_1,y_1,z_1)$ and $(x_2,y_2,z_2)$, respectively, the chord length $L_1$ of the arc AB can be expressed as:

$$L_1=\sqrt{(x_1-x_2)^2+(y_1-y_2)^2+(z_1-z_2)^2} \tag{11}$$

The arc length $C_1$ of the arc AB may be expressed as:

$$C_1=arc\sin(L_1/2r_{AB})\times\pi r_{AB}/90 \tag{12}$$

Similarly, the arc length $C_2$ of the arc CD can be obtained.

Step C: calculating the included angle a between two projection straight lines $l_1$ and $l_2$ of the left side arc AB and the right side arc CD of each vault splice plate in an OXY plane of the ideal coordinate system, respectively, the radius $r_1$ of the projection arc A'D' of the inside arc AD of each vault splice plate arranged in a circumferential direction of the vault in the OXY plane of the ideal coordinate system and the radius $r_2$ of the projection arc B'C' of the outside arc BC of each vault splice plate arranged in the circumferential direction of the vault in the OXY plane of the ideal coordinate system.

Figure 7:
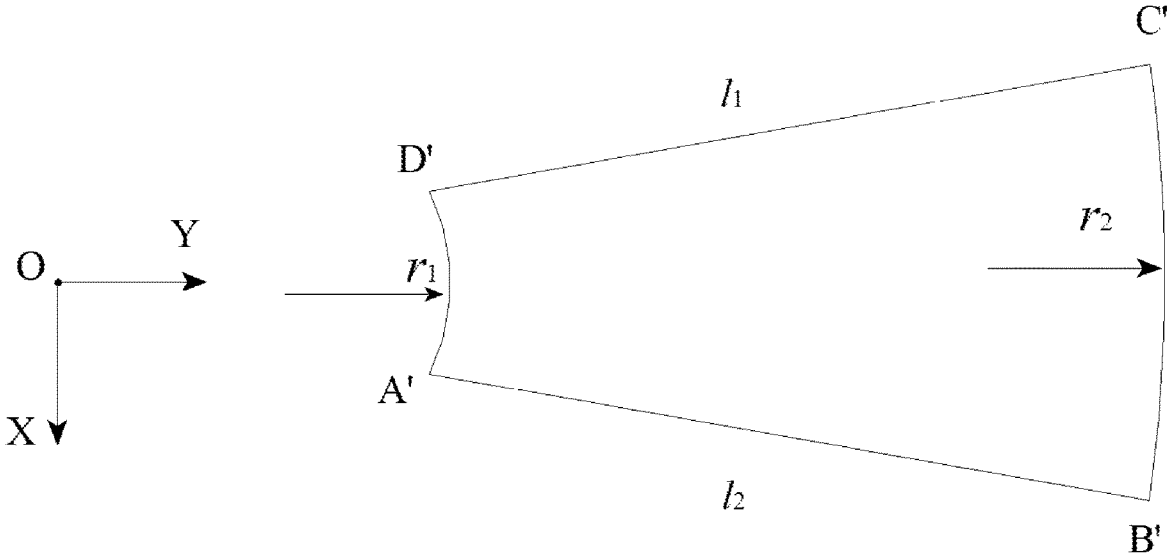
FIG. 7 is a projection diagram of the vault splice plates to be fitted in a Z-axis direction.

As shown in FIG. 6, the point cloud data of the vault splice plates is projected to the XOY plane in the Z-axis direction and ABCD corresponds to A'B'C'D' to obtain a sectorial trapezoid shown in FIG. 7, and two arcs A'D' and B'C' and two straight lines A'B' (that is $l_1$) and C'D' (that is $l_2$) perform curve fitting as follows:

Fitting the two arcs A'D' and B'C' by the least square method based on radius constraint to obtain the radius $r_1$ of the arc A'D' and radius $r_2$ of the arc B'C'. The specific method refers to the step A.

The equation of the straight line $l_1$ may be expressed as:

$$y=k_1x+b_1(k_1\neq 0) \tag{13}$$

Wherein, $k_1$ is the slope of the straight line $l_1$, and $b_1$ is the intercept of the straight line $l_1$.

The optimized target function for the straight line fitting based on a nonlinear least square method is:

$$\min C' = \sum_{i=1}^{N}(k_1x_i + b_1 - y_i)^2 \tag{14}$$

Similarly, the equation of the straight line $l_2$ may be expressed as:

$$y=k_2x+b_2(k_2\neq 0) \tag{15}$$

Wherein, $k_2$ is the slope of the straight line $l_2$, and $b_2$ is the intercept of the straight line $l_2$.

The optimized target function is:

$$\min C'' = \sum_{i=1}^{N}(k_2x_i + b_2 - y_i)^2 \tag{16}$$

After the equations of the two straight lines are obtained, the included angle a between the two straight lines $l_1$ and $l_2$ is expressed as:

$$\alpha = \arctan\left|\frac{k_2 - k_1}{1 + k_1k_2}\right| \tag{17}$$

Wherein, a is the included angle between the two straight lines, and $k_1$ and $k_2$ are the slope of the two straight lines.

(6) Performing construction layout of the vault splice plates, the detailed steps includes:

Step A: obtaining the radius $R_1$ of an inside arc MN and radius $R_2$ of an outside arc PQ of a construction layout plate of the vault splice plates arranged in the circumferential direction of the vault by the following formulae, respectively:

$$R_1 = XZ = OZ*\tan\left(\arcsin\frac{YZ}{OZ}\right) = \frac{r_{AB} + r_{CD}}{2}*\tan\left(\arcsin\frac{2r_1}{r_{AB} + r_{CD}}\right) \tag{18}$$

$$R_2 = \frac{r_{AB} + r_{CD}}{2}*\tan\left(\arcsin\frac{2r_2}{r_{AB} + r_{CD}}\right) \tag{19}$$

Figure 8:
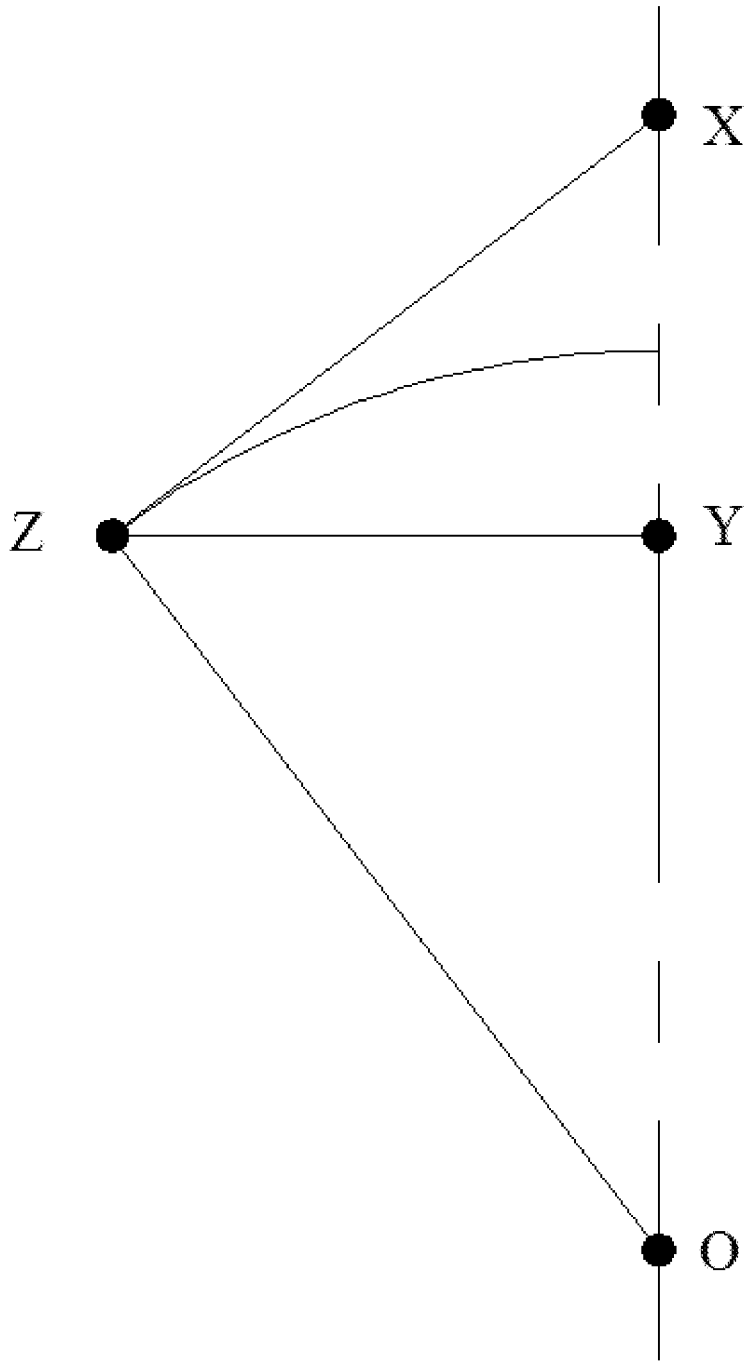
FIG. 8 is a schematic diagram of calculating the radius of a layout arc of a vault splice plate.
Figure 9:
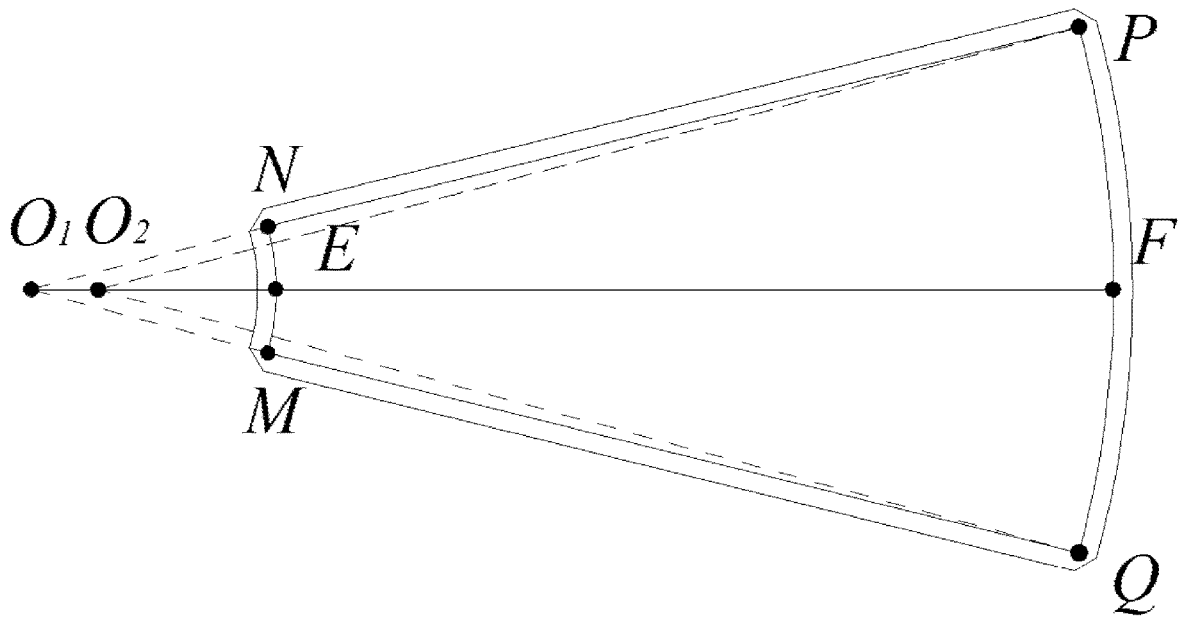
FIG. 9 is a schematic diagram of the layout dimension of a vault splice plate to be calculated.

Wherein, as shown in FIG. 8, OZ is an average value of the radius $r_{AB}$ of the left side arc AB and the radius $r_{CD}$ of the right side arc CD of each vault splice plate, and the point O in the OZ is the center of a vault sphere. When calculating the arc radius $R_1$ of the inside arc MN, the point Z in the OZ is selected from a point on the inside arc AD of the vault splice plate; when calculating the arc radius $R_2$ of the outside arc PQ, the point Z in the OZ is selected from a point on the outside arc BC of the vault splice plate. The tangent line of the arc of the tank top from the point Z is intersected at a point X with a vertical central line of the vault sphere, then XZ is the radius of the vault splice plate at the point Z, YZ is the length of a perpendicular line from the point Z to the vertical central line of the vault sphere. When the point Z is selected from the inside arc AD of the vault splice plate, YZ corresponds to the value of $r_1$; and, when the point Z is selected from the outside arc BC of the vault splice plate, YZ corresponds to the value of $r_2$, wherein $r_1$ is the radius of the projection arc A'D' of the inside arc AD of each vault splice plate arranged in the circumferential direction of the vault in the OXY plane of the ideal coordinate system, $r_2$ is the radius of the projection arc B'C' of the outside arc BC of each vault splice plate arranged in the circumferential direction of the vault in the OXY plane of the ideal coordinate system, $r_{AB}$ is the radius of the left side arc of each vault splice plate, and $r_{CD}$ is the radius of the right side arc CD of each vault splice plate;

Step B: As shown in FIG. 9, constructing a line segment EF, wherein the length of the EF is an average value of the arc length $C_1$ of the left side arc AB and the arc length $C_2$ of the right side arc CD of each vault splice plate in the radial direction of the vault:

$$EF=(C_1+C_2)/2 \tag{20}$$

Step C: constructing arcs MN and PQ by using the radius $R_1$ of the inside arc and the radius $R_2$ of the outside arc of the construction layout plate of the vault splice plates arranged in the circumferential direction of the vault as radius and using point E and point F as points on the arcs, wherein the centers of the arcs MN and PQ are $O_1$ and $O_2$ respectively and located on an extended line of the line segment EF; taking a as the central angle of each of the arcs MN and PQ, connecting the MQ and NP, and obtaining MNPQ as the layout dimension data of the steel plate to be calculated as shown in FIG. 9;

(7) Considering the lap width and the error caused by actual sphere expansion, shifting four sides of the MNPQ outwardly, where the offset may be ranged from 5 mm to 10 mm according to the construction experience; and, connecting clearances, formed at four corners after shifting, by straight lines to obtain a layout graph for the vault splice plates, finally prefabricating and constructing the vault splice plates to be mounted according to the layout graph for the vault splice plates.

What is claimed is:

1. A method of constructing a vault of a large storage tank for liquefied natural gas, comprising the steps of (a) modeling the vault of the large storage tank using a 3-D CAD application to generate a set of model data that display the vault as an umbrella type dome, formed from a plurality of panels fixed on a framework of parallels and meridians; (b) producing a first set of panels having shapes and dimensions predetermined according to the modeling data generated in step (a) and producing a plurality of framework members according to the modeling data generated in step (a); (c) on the top of a storage tank's main body, constructing a vault framework based on the model data generated in step (a) by connecting and fixing framework members to form the parallels and meridians of the framework; (d) partially covering the framework built in step (c) by fixing the first set of panels according to the vault model of step (a), wherein the panels do not touch each other but leave a plurality of uncovered spaces between the panels; (e) obtaining dimensional data of the uncovered spaces by using a 3-D scanner and producing a second set of panels according to the scanned dimensional data, each of which panels fits in one of the uncovered spaces; and (f) placing and fixing the second set of panels into the uncovered spaces between the first set of panels that are already fixed on the framework to result in fully covered vault as the top of the storage tank.

2. The method according to claim 1, wherein the size of the second panels is smaller than the size of the first set of panels.

3. The method according to claim 2, wherein the second set of the panels are of at least three types, each with a different size and shape.

4. The method according to claim 2, wherein the first set of the panels are of different sizes and shapes.

5. The method according to claim 4, wherein the first set of the panels are of two types, one type of which has a larger size than the other type.

* * * * *